US005880395A

United States Patent [19]

Krumm et al.

[11] Patent Number: 5,880,395

[45] Date of Patent: Mar. 9, 1999

[54] GUN TURRET ASSEMBLY FOR AN ARMORED VEHICLE

[75] Inventors: Herbert Krumm, Kaarst; Wilfried Becker, Celle; Udo Weinfurth, Düsseldorf, all of Germany

[73] Assignee: Rheinmetall Industrie AG, Ratingen, Germany

[21] Appl. No.: 957,326

[22] Filed: Oct. 24, 1997

[30] Foreign Application Priority Data

Oct. 26, 1996 [DE] Germany ..... 196 44 524.8

[51] Int. Cl.[6] ..... F41A 9/42

[52] U.S. Cl. ..... 89/46; 89/47

[58] Field of Search ..... 89/46, 47, 45, 89/33.05

[56] References Cited

U.S. PATENT DOCUMENTS

| | | | |
|---|---|---|---|
| 1,332,060 | 2/1920 | Pacilli | 89/33.05 |
| 2,649,840 | 8/1953 | Davidson, Jr. | 89/45 |

FOREIGN PATENT DOCUMENTS

| | | | |
|---|---|---|---|
| 51119 | 5/1982 | European Pat. Off. | 89/47 |
| 338301 | 10/1989 | European Pat. Off. | 89/46 |
| 557751 | 9/1993 | European Pat. Off. | 89/47 |
| 2467379 | 4/1981 | France | 89/47 |
| 1 301 742 | 4/1970 | Germany . | |
| 34 37 588 | 4/1986 | Germany . | |
| 25 01 426 | 11/1988 | Germany . | |

*Primary Examiner*—Stephen M. Johnson
*Attorney, Agent, or Firm*—Venable; Gabor J. Kelemen

[57] ABSTRACT

A weapon assembly for an armored vehicle includes a turret; a turret cage attached to and being disposed underneath the turret; a weapon supported in the turret and having a barrel; and a belt magazine received in part in the turret and in part in the turret cage. The belt magazine has a loading belt and a plurality of horizontally disposed, ammunition-accommodating container tubes attached to the loading belt. The belt magazine further has a frontal receiving position above the turret cage and laterally of the turret. A loading tube is swingably supported behind the weapon for movement between a first position and a second position. In the first position the loading tube is in alignment with the container tube when the latter is in the frontal receiving position. In the second position the loading tube is in alignment with the weapon barrel in a rearward receiving position. There are further provided a first loading device for pushing ammunition from the container tube, when situated in the frontal receiving position, into the loading tube and a second loading device for pushing ammunition, in the rearward receiving position, from the loading tube into a loading chamber of the weapon.

7 Claims, 5 Drawing Sheets

GUN TURRET ASSEMBLY FOR AN ARMORED VEHICLE

CROSS REFERENCE TO RELATED APPLICATION

This application claims the priority of German Application No. 196 44 524.8 filed Oct. 26, 1996, which is incorporated herein by reference.

BACKGROUND OF THE INVENTION

This invention relates to a weapon assembly for an armored vehicle and is of the type which has a gun turret, a weapon supported in the turret and having a barrel, a turret cage and a loading device for transporting to the weapon ammunition stored in a magazine in the turret.

For storing large caliber ammunition in a magazine in an armored vehicle, it is known, for example, from German Offenlegungsschrift (application published without examination) No. 34 37 588 to store the ammunition in the rear region of the turret and to load ammunition into the weapon by means of a loading device according to requirements. It is, among others, a disadvantage of storing ammunition in such a manner that a substantial space in the rear part of the turret is needed and further, the vehicle is vulnerable to a substantial degree because of the exposed disposition of the ammunition.

The above-outlined disadvantages may also be found in armored vehicles in which the ammunition magazine is arranged laterally of the weapon, as disclosed, for example, in German Patent No. 2,501,426.

Further, as disclosed in German Patent No. 1,301,742, the ammunition is disposed partially in the lower region (turret cage) of the weapon turret so that the ammunition situated there is better protected than if positioned in the upper region of the turret. It is, however, a disadvantage of such an arrangement that, among others, the turret cage must have a substantial volume because the ammunition is swung by a loading device from a lower receiving position to a location behind the breech ring of the weapon.

SUMMARY OF THE INVENTION

It is an object of the invention to provide an improved weapon assembly, in the turret cage of which more large-caliber ammunition may be magazined than in conventional weapon turrets of comparable dimensions without, however, adversely affecting the firing speed.

This object and others to become apparent as the specification progresses, are accomplished by the invention, according to which, briefly stated, the weapon assembly for an armored vehicle includes a turret; a turret cage attached to and being disposed underneath the turret; a weapon supported in the turret and having a barrel; and a belt magazine received in part in the turret and in part in the turret cage. The belt magazine has a loading belt and a plurality of horizontally disposed, ammunition-accommodating container tubes attached to the loading belt. The belt magazine further has a frontal receiving position above the turret cage and laterally of the turret. A loading tube is swingably supported behind the weapon for movement between a first position and a second position. In the first position the loading tube is in alignment with the container tube when the latter is in the frontal receiving position. In the second position the loading tube is in alignment with the weapon barrel in a rearward receiving position. There are further provided a first loading device for pushing ammunition from the container tube, when situated in the frontal receiving position, into the loading tube and a second loading device for pushing ammunition, in the rearward receiving position, from the loading tube into a loading chamber of the weapon.

Essentially, the invention is based on the principle to utilize, as the ammunition magazine, a turret-cage belt-magazine in which the ammunition is arranged horizontally in container tubes secured to a loading belt and carried by the loading belt to a frontal receiving position which is situated laterally and approximately at the height level of the weapon. In the frontal receiving position the ammunition is pushed with the aid of a first loading device into a loading tube which is thereafter swung behind the breech ring to a rear receiving position where, by means of a second loading device, the ammunition is pushed into the weapon chamber.

A gun turret structured according to the invention not only permits the firing of a relatively large number of shots of large-caliber ammunition (for example, having a caliber of 140 mm and a length of 1.5 m) while the dimensions of the turret cage are maintained relatively small (for example, an inner diameter of less than 1.8 m), but, because of the simple motion sequence, a relatively high firing frequency (for example, 5–10 rounds per minute) may be achieved. Further, the ammunition is, because its positioning in the turret cage, protected against external influences, such as enemy fire.

The gun turret structured according to the invention is especially adapted to store in a magazine and to automatically load particularly large ammunition of new design such as ammunition for a 140 mm main tank weapon.

For reducing the dimensions of the rearward region of the gun turret, according to an advantageous feature of the invention a container tube, when in the frontal receiving position, and the loading tube are at a rearwardly-oriented inclination to a vertical plane containing the barrel axis, whereby a swinging motion of the loading tube from the frontal receiving position to the rear receiving position describes a frustoconical surface. By virtue of such an arrangement of the belt magazine (or belt magazines) and the loading device, the bottom of the rear region of the turret may be raised, so that more free space is made available, for example, for the coolant exhaust of the vehicle.

According to the invention one-part or two-part ammunition may be fired from the weapon installed in the weapon turret.

For the magazine storage of two-part ammunition two axially successive belt magazines may be used. Such a magazine arrangement is advantageous particularly in case of especially long, large-caliber ammunition. In such a case the ammunition portion containing the projectile is disposed in the frontal belt magazine (as viewed in the firing direction), whereas the ammunition part which contains only the propellant charge is disposed in the rearward belt magazine. The disposition of the two belt magazines has to be such that the corresponding container tubes are in alignment behind one another in the frontal receiving position, so that both ammunition parts may be pushed into the respective loading tube by the frontal loading device.

An aligned arrangement of the container tubes of the two belt magazines is, to be sure, not required inside the turret cage. Rather, for reasons of an optimal positioning of the ammunition parts it has been found to be advantageous to dispose the container tubes for longer ammunition parts (as a rule, the ammunition parts containing the projectile) laterally and obliquely in the inside of the turret cage, so that the respective loading belt has an upwardly twisted orientation.

To increase the free space of the breech ring of the weapon, it has been found advantageous to provide for an axial displaceability of the rearward belt magazine.

According to another advantageous feature of the invention the loading tube is telescopically collapsible, so that during firing of the weapon it may remain behind the breech ring of the weapon barrel (in the rear receiving position) and is pushed together by the weapon barrel without causing any damage. When the weapon barrel moves back into its initial position, the loading tube is deployed and is swung back into the frontal receiving position.

DESCRIPTION OF THE PREFERRED EMBODIMENTS

Figure 1:
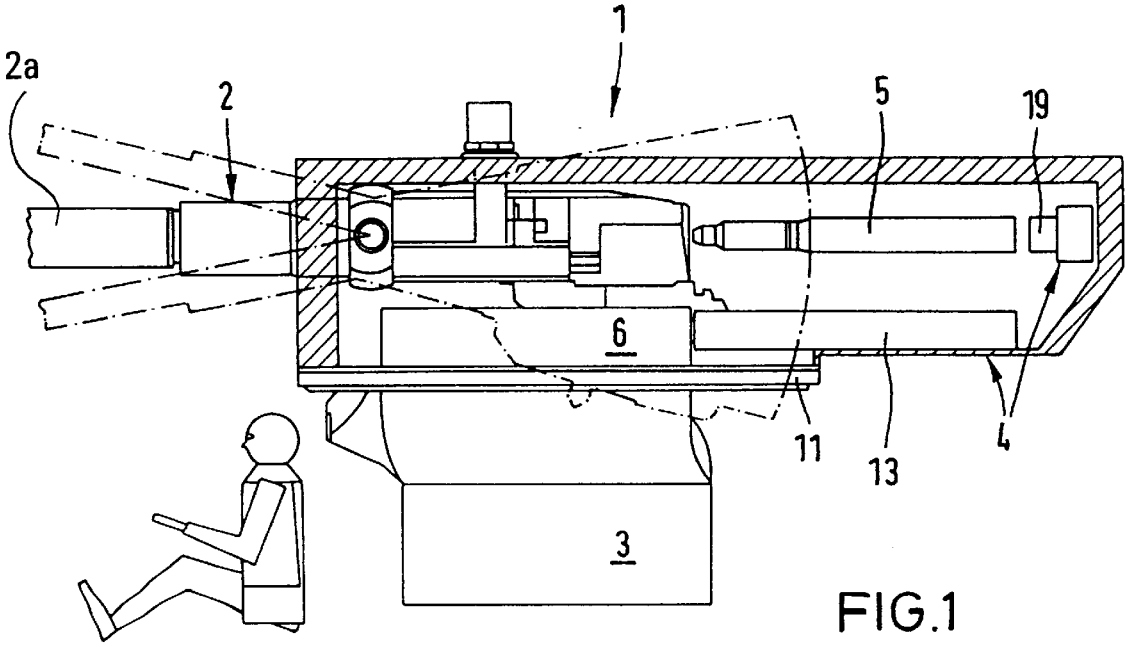
FIG. 1 is a schematic sectional side elevational view of a weapon assembly according to a preferred embodiment of the invention.
Figure 2:
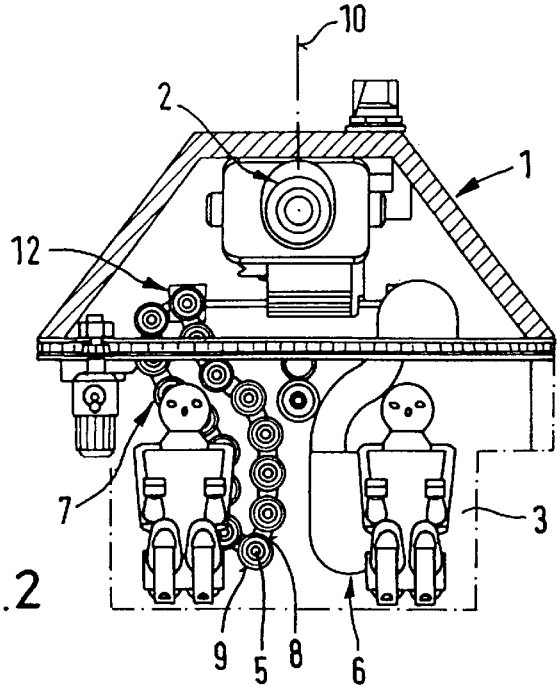
FIG. 2 is a sectional front elevational view of the structure shown in FIG. 1.
Figure 3:
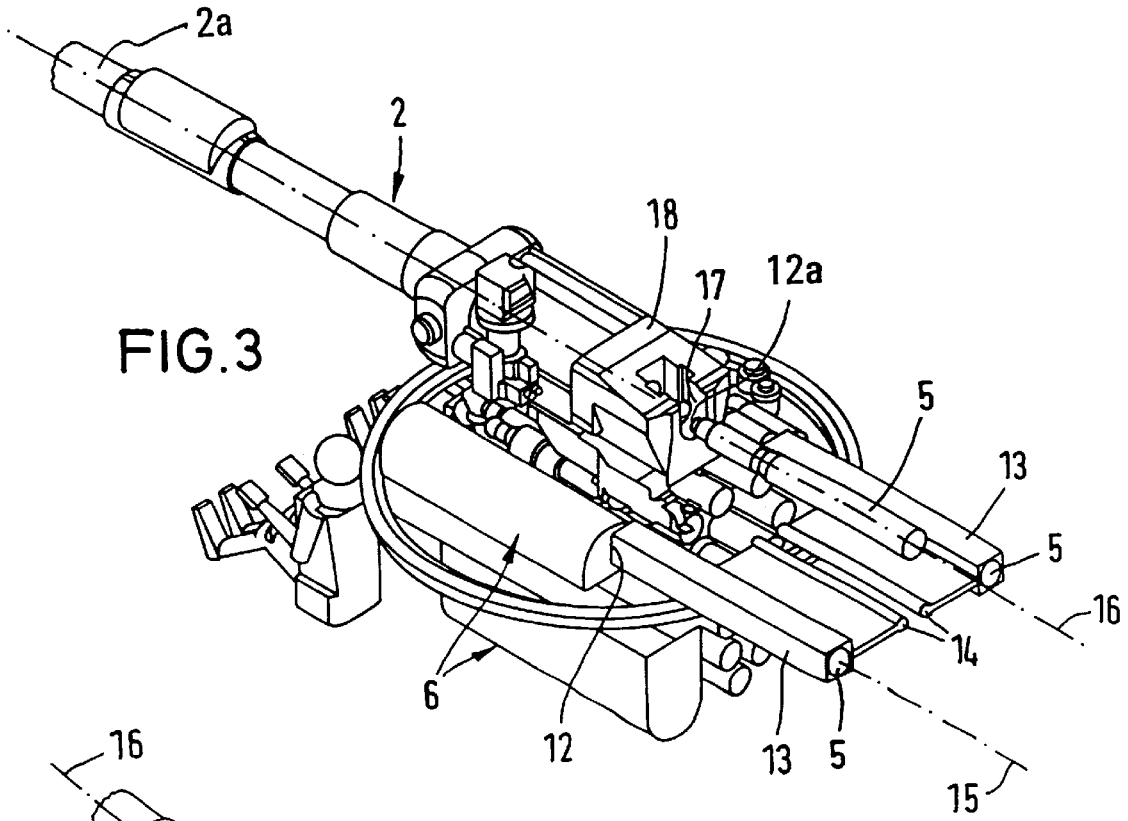
FIG. 3 is a perspective view of the structure shown in FIGS. 1 and 2 (with the armor removed), having a one-part, axially shifted belt magazine.

Turning to FIGS. 1–3, a gun turret 1 includes a weapon 2 having a barrel 2*a*, a turret cage 3 and a loading device 4 for introducing ammunition 5 into the weapon 2. With particular reference to FIG. 2, in the gun turret 1 two belt magazines 6 and 7 are provided, each including an endless loading belt 8 and a plurality of container tubes 9 which are secured to the respective loading belt 8 and which serve for accommodating the ammunition 5. The respective endless loading belt 8 has a curved, offset course and is guided in a loop essentially parallel to the turret axis 10 through the turret cage 3, so that the greatest part of the container tubes 9—and thus also the ammunition 5 accommodated therein—is situated within the turret cage 3. Above the turret ring gear 11 of the gun turret 1 a frontal receiving position 12 is provided where the respective ammunition 5 is moved by a first (frontal) loading device (which is not illustrated for the sake of clarity) from the container tube 9 into a loading tube 13.

Each loading tube 13 is, as shown in FIG. 3, supported or pivotal motion about a respective rotary axle 14 in such manner that for a given indexing position of the weapon 2 the loading tube 13 is so pivoted into a rear receiving position 12*a* that its longitudinal axis 15 is brought into alignment with the axis 16 of the barrel 2*a*. As a result, the ammunition 5 may be pushed through the loading opening 17 of the breech ring 18 into the chamber of the weapon 2 by means of a second (rearward) loading device 19 shown in FIG. 1.

The loading of the weapon 2 may be effected alternatingly from either side, because the corresponding belt magazines 6 and 7, the frontal loading devices and the loading tubes 13 are arranged on either side of the weapon 2. It has been found advantageous to design the loading tube 13 as a telescopically collapsible structure, so that upon firing the weapon 2, the loading tube 13 may remain behind the breech ring 18 of the weapon 2 in the rear receiving position 12*a* and may be telescopically compressed by the weapon 2 without damage. When the weapon barrel 2*a* returns into its original position, the loading tube 13 deploys once again and may be pivoted into the frontal receiving position 12.

Figure 4:
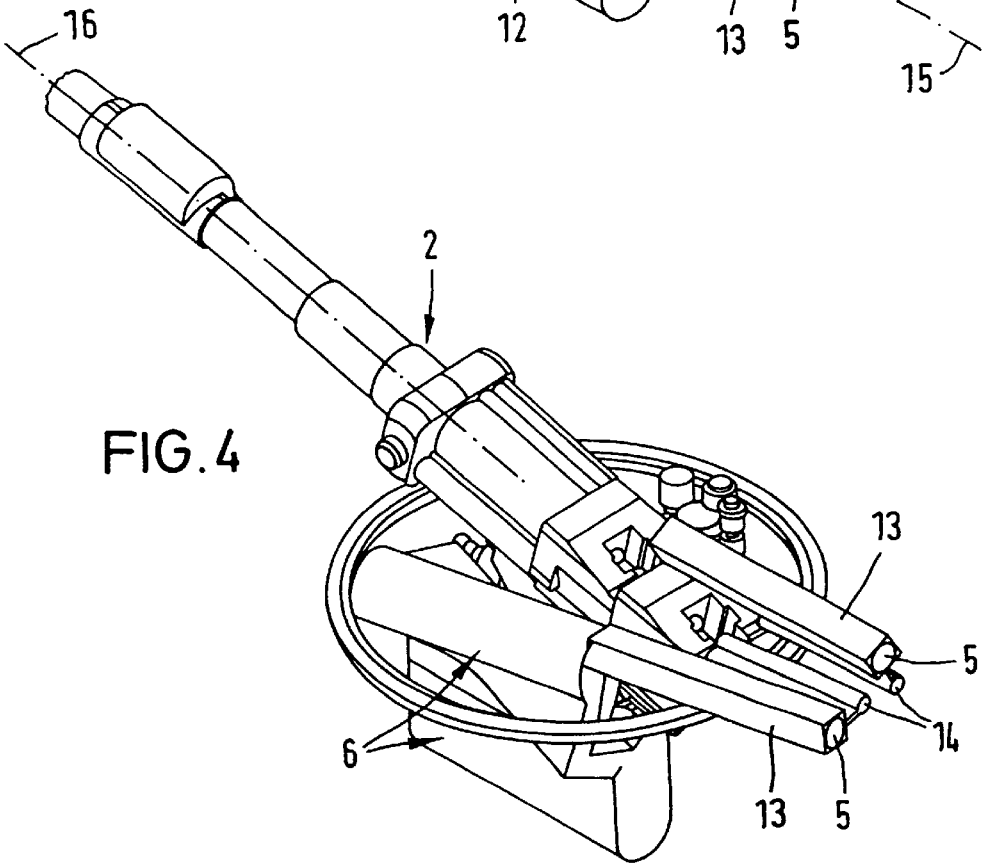
FIG. 4 is a perspective view similar to FIG. 3, illustrating a further preferred embodiment of the invention having a one-part, axially not-shifted belt magazine.

Turning to FIG. 4, for reducing the spatial requirement in the rearward turret region, the container tubes 9 of the belt magazines 6, 7, when in the frontal receiving position, and the adjoining loading tubes 13 converge rearwardly toward an imaginary vertical plane in which the barrel axis 16 lies, so that during the loading process the respective operative loading tube 13 is pivoted along a frustoconical surface from the frontal receiving position into the rear receiving position behind the weapon barrel 2*a*.

The weapon 2 may be used for one-part or two-part ammunition. In the latter case both ammunition parts are loaded into the corresponding container tube 9 and are subsequently pushed into the loading tube 13 by means of the frontal loading device.

Figure 5:
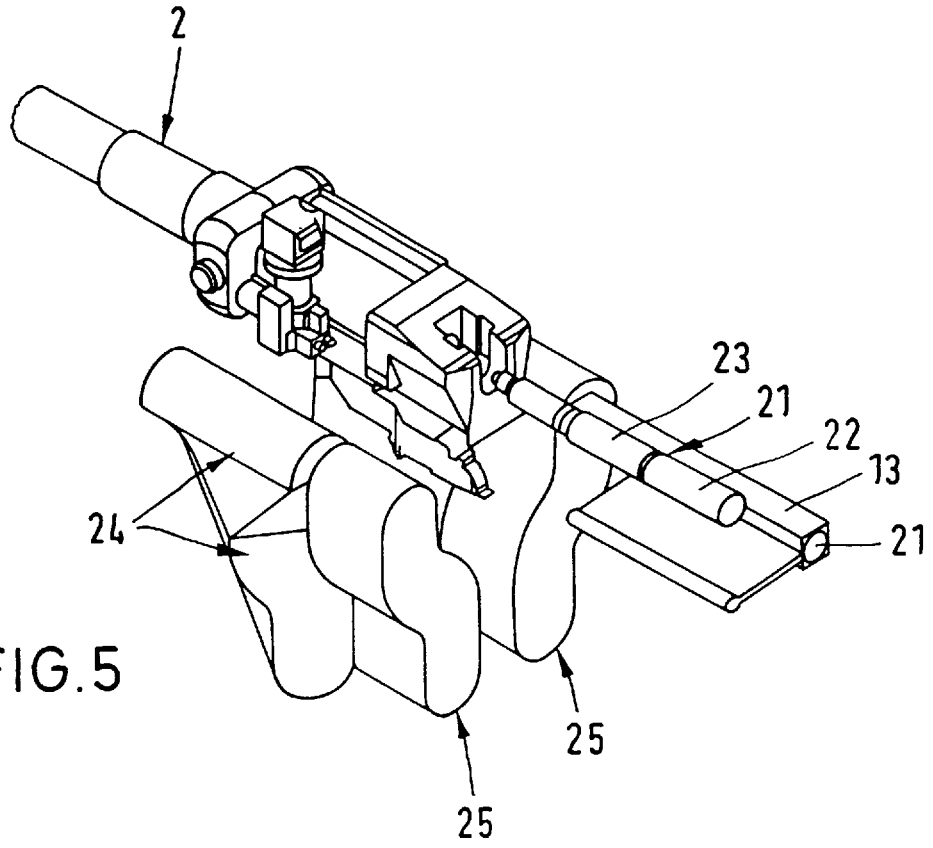
FIG. 5 is a perspective view of still another preferred embodiment of the weapon assembly according to the invention, wherein belt magazines for loading two-part ammunition are provided.
Figure 6:
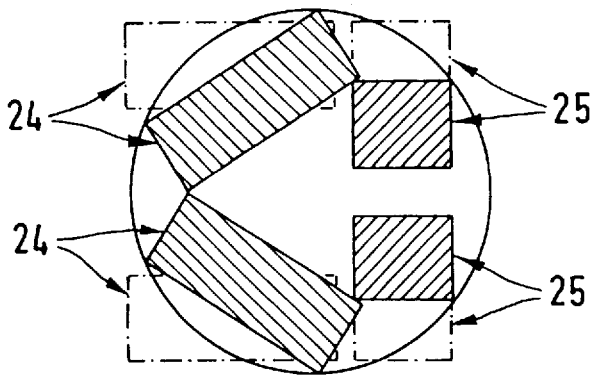
FIG. 6 is a schematic top plan view of the belt magazines shown in FIG. 5.

FIGS. 5 and 6 show a gun turret where on each side of the weapon 2 two belt magazines are arranged behind one another for loading two-part ammunition. In this arrangement, in the frontal belt magazine (as viewed in the firing direction) the projectile and in the rearward belt magazine only the ammunition part containing the propellant are stored.

Thus, the weapon 2 of FIG. 5 is to be supplied with an only schematically shown two-part ammunition 21. The ammunition 21 is formed of a rearward ammunition part 22 which essentially contains only the propellant and a frontal ammunition part 23 which contains the projectile and which may additionally contain propellant.

As noted above, on either side of the weapon 2 two belt magazines 24 and 25 are provided which are arranged behind one another and which, by means of an arcuate construction, extend into the inside of the turret cage 3. Each frontal belt magazine 24 serves for receiving the ammunition part 23 containing the projectile, whereas the respective rearward belt magazine 25 serves for receiving the ammunition part 22 containing the propellant.

For an optimal arrangement of the ammunition parts, the belt magazine 24 which receives the projectile has a laterally inclined position in the inside of the turret cage 3 since these ammunition parts are relatively long, particularly in case of large-caliber ammunition. It is noted that in FIG. 6, the position of the container tubes in the inside of the turret cage is shown shaded.

The arrangement of the loading belts of the two belt magazines 24, 25 has to be such that the corresponding container tubes are in alignment behind one another in the frontal receiving position so that both ammunition parts 22, 23 may be pushed into the respective loading tube 13 by the first loading device. In FIG. 6, the corresponding position of the container tubes in the frontal receiving position is shown in phantom lines. In FIG. 5 only one loading tube is shown for reasons of clarity.

Figure 7:
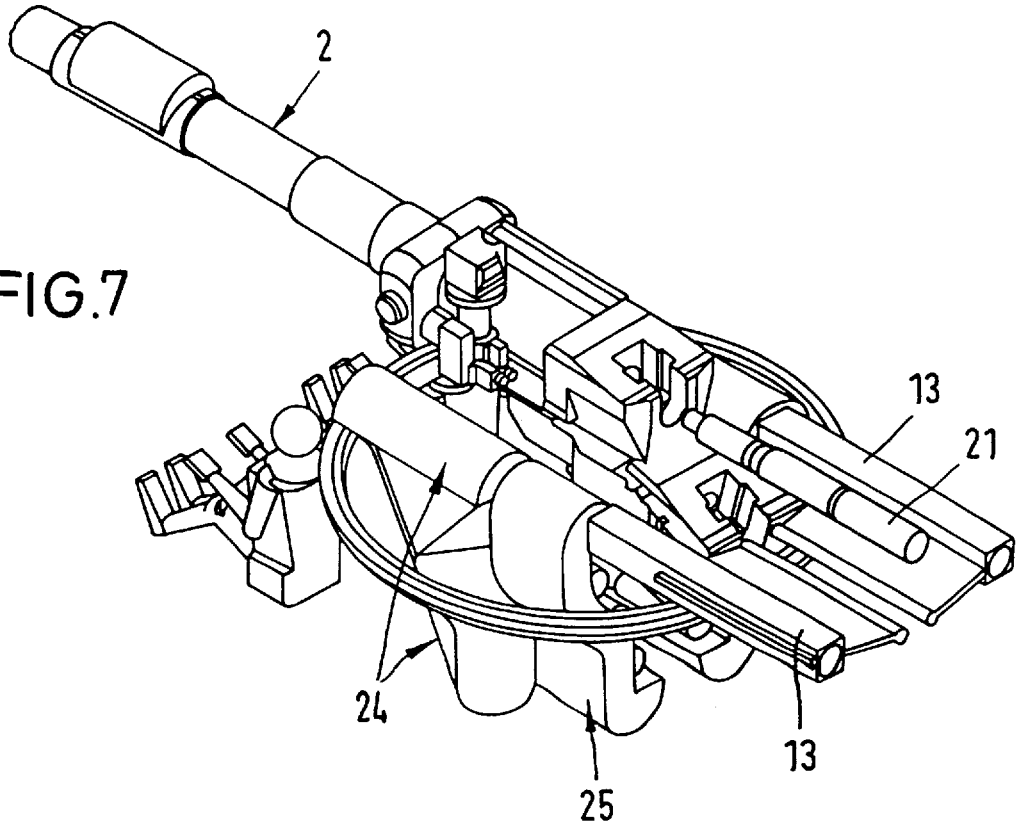
FIG. 7 is a perspective view, similar to FIG. 3, of yet another preferred embodiment of the invention for loading two-part ammunition.
Figure 8:
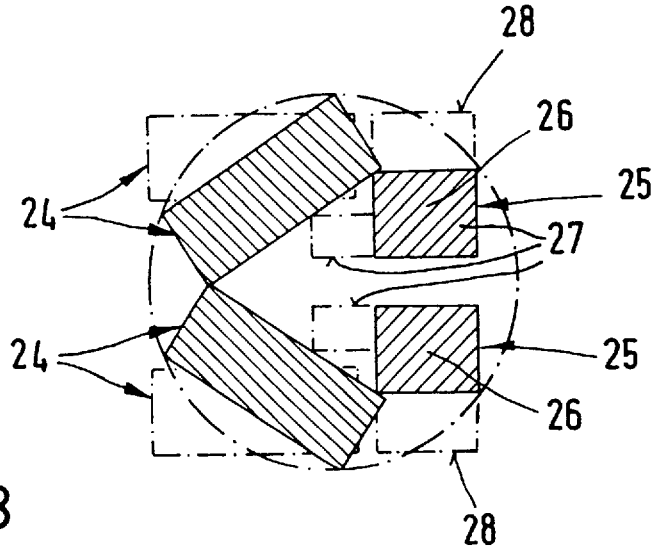
FIG. 8 is a schematic top plan view of the belt magazines shown in FIG. 7.

As shown in FIGS. 7 and 8, for increasing the free space of the breech ring 18 for elevations of the weapon 2, it has been found to be advantageous to provide for an axial displaceability of the loading belt of that belt magazine which receives the propellant. In FIG. 8 the position of the ammunition in the zone of the turret cage bottom is designated at 26, whereas the position of the ammunition which is situated thereabove, but still in the region underneath the weapon, is designated at 27 and the position of the ammunition in the frontal receiving position is designated at 28. As it may be seen in FIG. 8, the ammunition in the region 27 is shown shifted in the firing direction, so that the breech ring of the weapon, set to a certain elevation, cannot collide with the ammunition situated underneath the weapon.

Figure 9:
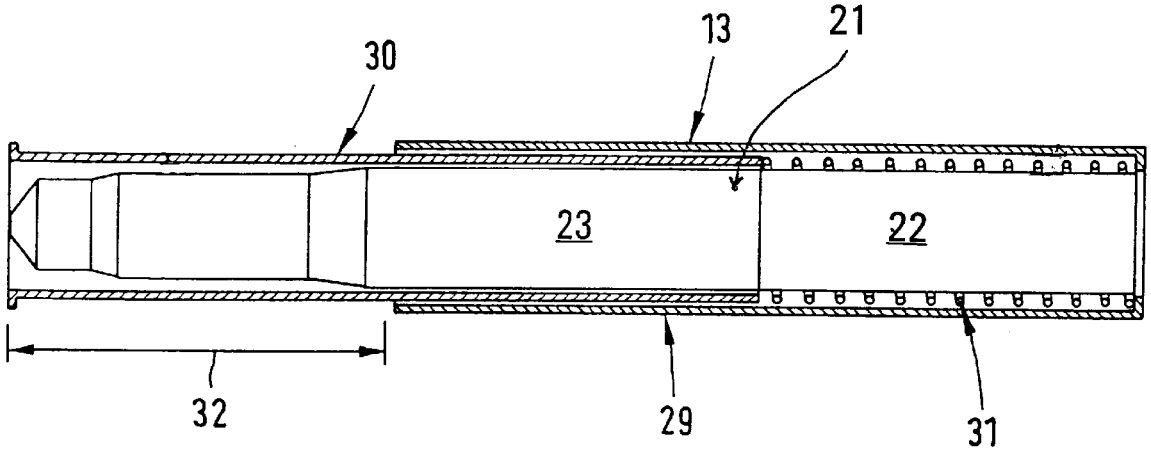
FIG. 9 is an axial sectional view illustrating a telescopically collapsible loading tube containing a two-part ammunition.

FIG. 9 shows an embodiment of a telescopically collapsible loading tube 13 containing a two-part ammunition 21 formed of a propellant part 22 and a projectile part 23. The loading tube 13 is essentially formed of a stationary tube part 29 and a tube part 30 which may be telescoped into the tube part 29 and which is axially outwardly biased by a return spring 31. The maximum telescoping motion which is adapted to the recoil of the respective weapon is indicated at 32.

It will be understood that the above description of the present invention is susceptible to various modifications, changes and adaptations, and the same are intended to be comprehended within the meaning and range of equivalents of the appended claims.

What is claimed is:

1. A weapon assembly for an armored vehicle, comprising (a) a turret;

(b) a turret cage attached to and being disposed underneath said turret;

(c) a weapon supported in said turret and having a barrel defining a barrel axis;

(d) a belt magazine received in part in said turret and in part in said turret cage; said belt magazine having a loading belt and a plurality of horizontally disposed, ammunition-accommodating container tubes attached to said loading belt; said belt magazine having a frontal receiving position above said turret cage and laterally of said turret;

(e) a loading tube swingably supported behind said weapon for movement between a first position and a second position; in said first position said loading tube being in alignment with the container tube when said container tube is in said frontal receiving position, and in said second position said loading tube being in alignment with the barrel in a rearward receiving position;

(f) a first loading device for pushing ammunition from the container tube, when situated in said frontal receiving position, into said loading tube; and (g) a second loading device for pushing ammunition, when in said rearward receiving position, from said loading tube into a loading chamber of said weapon.

2. The weapon assembly as defined in claim 1, wherein said frontal receiving position said container tube and said loading tube are at a rearwardly-oriented inclination to a vertical plane containing said barrel axis, whereby a swinging motion of said loading tube between said first and second positions thereof describes a frustoconical surface.

3. The weapon assembly as defined in claim 1, wherein said belt magazine is a first belt magazine; further comprising a second belt magazine structured essentially identically to said first belt magazine; said first and second belt magazines being positioned behind one another as viewed in a firing direction of said weapon, whereby one of said first and second belt magazines is a frontal belt magazine and the other of said first and second belt magazines is a rear belt magazine; the container tubes of said frontal belt magazine accommodating first ammunition parts constituting projectiles and the container tubes of said rear belt magazine accommodating second ammunition parts constituting propellant; the container tube of said frontal belt magazine and the container tube of said rear belt magazine being in alignment behind one another for allowing said first loading device to push said first and second ammunition parts together into said loading tube.

4. The weapon assembly as defined in claim 3, wherein the container tubes of said first belt magazine have a laterally inclined orientation in said turret cage, whereby the magazine belt of said first belt magazine has a twisted orientation towards said frontal receiving position.

5. The weapon assembly as defined in claim 3, wherein said second belt magazine is axially displaceable towards an end of said barrel.

6. The weapon assembly as defined in claim 1, wherein said loading tube has a plurality of telescoping parts allowing the loading tube to be telescopically pushed together by said barrel upon recoil thereof.

7. The weapon assembly as defined in claim 1, wherein said belt magazine is a first belt magazine; further comprising a second belt magazine structured essentially identically to said first belt magazine; said first and second belt magazines being positioned laterally on opposite sides of said weapon and extending into said turret cage.

* * * * *